US009180720B2

(12) United States Patent
Ganter

(10) Patent No.: US 9,180,720 B2
(45) Date of Patent: Nov. 10, 2015

(54) METHOD FOR OPERATING A BOOK FORMING AND PRESSING MACHINE

(71) Applicant: Mueller Martini Holding AG, Hergiswil (CH)

(72) Inventor: Christian Ganter, Bieberehren (DE)

(73) Assignee: Mueller Martini Holding AG, Hergiswil (CH)

( * ) Notice: Subject to any disclaimer, the term of this patent is extended or adjusted under 35 U.S.C. 154(b) by 374 days.

(21) Appl. No.: 13/873,974

(22) Filed: Apr. 30, 2013

(65) Prior Publication Data

US 2013/0287524 A1 Oct. 31, 2013

(30) Foreign Application Priority Data

Apr. 30, 2012 (CH) ..... 00600/12

(51) Int. Cl.

| | |
|---|---|
| ***B42C 19/00*** | (2006.01) |
| ***B42C 5/02*** | (2006.01) |
| ***B42C 13/00*** | (2006.01) |
| ***B42C 9/00*** | (2006.01) |
| ***B42C 11/04*** | (2006.01) |

(52) U.S. Cl.

CPC . *B42C 19/00* (2013.01); *B42C 5/02* (2013.01); *B42C 9/0025* (2013.01); *B42C 11/04* (2013.01); *B42C 13/00* (2013.01); *B42C 13/003* (2013.01)

(58) Field of Classification Search

CPC ..... B42C 13/00; B42C 13/003; B42C 5/02
USPC ..... 412/22, 23, 30, 902
See application file for complete search history.

(56) References Cited

U.S. PATENT DOCUMENTS

| | | | | |
|---|---|---|---|---|
| 2,516,460 | A * | 7/1950 | Getzoff | 412/30 |
| 3,413,669 | A * | 12/1968 | Thorp | 412/30 |
| 2008/0136158 | A1* | 6/2008 | Brommer et al. | 412/30 |

(Continued)

FOREIGN PATENT DOCUMENTS

| | | | |
|---|---|---|---|
| DE | 4422783 | A1 | 1/1996 |
| DE | 19741755 | A1 | 6/1999 |

(Continued)

OTHER PUBLICATIONS

Liebau, Dieter et al. "Industrielle Buchbinderei," 2001, Verlag Beruf & Schule [XP002681496].
International Search Report of CH 6002012 Dated Sep. 7, 2012 with an English Translation.

*Primary Examiner* — Kyle Grabowski
(74) *Attorney, Agent, or Firm* — Venable LLP; Robert Kinberg

(57) ABSTRACT

A method for operating a book forming and pressing machine that includes a pressing device and a re-forming device to form a front cut of a book block. Values relating to the book block are determined with a higher order control along a book production line upstream of the book forming and pressing machine. The determined values are transmitted to the pressing device, the re-forming device and/or pressing plates of the pressing device for finishing the book block. A forming tool of the re-forming device is selected based on values that meet operational requirements for the processing of the front cut. The selected forming tool is moved in a plane or space to an operating position for forming the front cut of the respective book block. Movement of the pressing plates is controlled based on the measured book thickness and thickness of the book cover for the book block.

19 Claims, 6 Drawing Sheets

(56) References Cited

U.S. PATENT DOCUMENTS

| | | | | |
|---|---|---|---|---|
| 2008/0138172 | A1* | 6/2008 | Brommer et al. | 412/22 |
| 2008/0138173 | A1* | 6/2008 | Brommer et al. | 412/22 |

FOREIGN PATENT DOCUMENTS

| | | | |
|---|---|---|---|
| DE | 102004026627 | * | 6/2004 |
| EP | 0309736 | * | 4/1989 |

* cited by examiner

METHOD FOR OPERATING A BOOK FORMING AND PRESSING MACHINE

CROSS-REFERENCE TO RELATED APPLICATION

This application claims the priority of Swiss Patent Application No. 00600/12, filed on Apr. 30, 2012, the subject matter of which is incorporated herein by reference.

BACKGROUND OF THE INVENTION

The invention relates to a method for operating a book forming and pressing machine which essentially consists of a re-forming device, a pressing device, and a loading device, wherein the loading device essentially is formed by a loading table and wherein the pressing device consists of a number of spaced-apart pressing plates and burn-in rails. The re-forming device is provided with a forming tool to shape or form the front cut on a book block, wherein the pressing device is operated with at least one station for accommodating a book block, and wherein the forming tool executes a series of movements in a plane or in space to form the front cut.

Known book forming and pressing machines are used in known book production lines for one of the last finishing steps in book production, meaning for the re-forming of a book block that has already been combined with a book cover.

A book forming and pressing machine is disclosed in German patent document DE 4422783 A1, which machine comprises a number of pressing devices with thereon arranged joint-burn-in devices, positioned on a rotor which is driven intermittently around a vertical axis of rotation. The books, which are supplied to a feed-in station of a pressing device that completely accommodates the books, are formed continuously via burn-in rail and are held by the same pressing plate until they are discharged at the discharge station. Between the feeding of the book blocks encased in covers and the discharge of the formed and pressed books, the rotor executes several intermittent rotational movements which are utilized as intervals for the pressing and/or burn-in operations.

The German patent document DE 19741755 A1 also discloses a method for setting up a book binding machine, comprising processing stations with servo components which are arranged along the material flow. The problem defined for this document is that the servo components are adjusted with computer control on the basis of specified adjustment variables. With respect to an improvement in the product quality and a shortening of the setup times, the document discloses that the results of individual functions of the process are determined with the aid of data recorders as actual values for a finished product and the resulting variables are then transmitted to a control computer for comparison. Empirical values stored in the control computer are used for adjusting the servo components, wherein the actual value of the finished product is compared in the control computer with the desired value for the finished product, taking into consideration an actual value for the fed-in product which is known to the station and is compared to the empirical values. In case of a deviation from the desired value, the servo components are automatically readjusted. However, one skilled in the art cannot find anywhere in the complete document a teaching describing the steps for a technical action because each operation for a book production is carried significantly by so-called empirical values which are stored in the control computer. This document consequently does not offer instructions to one skilled in the art for recreating the method.

Book forming and pressing machines which are known per se thus feed a book with the aid of a loading device into a pressing device and between two pressing plates. The books consist of book blocks encased in book covers and for the most part have a rounded book block back, with the front cut arranged opposite the back. The book block is positioned with its back resting on a loading table in the book forming and pressing machine and is subjected to a re-forming operation. In the process, joints are formed in the book, using burning rails, while the book is positioned in the book forming and pressing machine. The books are held in place between the pressing plates until they are discharged from the book forming and pressing machine.

A known re-forming device used for the re-forming operation is provided with a vertically adjustable forming tool, also called a loading punch or a die, which can be lowered onto the front cut. If the burn-in rails are closed only slightly and no pressure or only a slight pressure is exerted with the pressing plates onto the cased-in book block, the book block can be pressed into the back of the cover by lowering the forming tool against the front cut. The back insert and the flyleaf, as well as the two book cover sections, are pressed in a joint against the forming rails, so as to form a joint. With this method, it is important for the quality of the produced books that the forming tool faces the front cut and that its form matches the format of the book to be created.

With industrial book production lines, continuously changing book formats and small editions, up to the production of a single book, not only require frequent replacement of these forming tools but also require frequent replacements and more comprehensive adaptations of the book forming and pressing machine on the whole.

With the known methods and machines, the loading height for the book is individually adjusted during the loading of a book into the book forming and pressing machine, using a visual inspection, since the form of the book back and the thickness of the back insert influence the position of the book on the loading table, meaning the loading height must be changed.

Following the loading operation, a machine operator must take care to ensure that the forming edge has been positioned in a region for the burn-in rail and that the tools which must be replaced in the book forming and pressing machines have been selected to match the form of the book. According to the prior art, these forming tools are adjusted by sight.

A method of this type no longer meets the current order situation for an industrial book production line.

SUMMARY OF THE INVENTION

It is an object of the present invention to remedy this problem.

It is another object of the invention to ensure a flexible adaptation of the elements used in the book forming and pressing machine when using a method of the aforementioned type, so as to meet the requirements posed by differences in the formats, consistency and configuration of the books to be produced, as well as to move these elements to the operating position without manual intervention.

It is yet another object of the invention to use a book forming and pressing machine of the generic type with the goal of controlling as many of the connected work stations as possible with an automatic format adjustment, designed to avoid a replacement of parts or utilize a motorized adjustment with the aid of information relating to forming values, generated in the upstream-arranged machine, e.g. the rounding height, the rounding width, the rounding radius, the joint edge, wherein these values are then transmitted continuously by the control unit to the book forming and pressing machine.

The above and other objects are accomplished according to the invention, which in one embodiment provides for a method for operating a book forming and pressing machine including a re-forming device, a pressing device and a loading device, wherein the loading device includes a loading table and the pressing device includes a number of spaced-apart pressing plates and burn-in rails, wherein the re-forming device includes a plurality of forming tools adapted to form a front cut of a book block, and the pressing device includes at least one station to accommodate a book block, the method comprising: executing a series of movements by one of the forming tools in a plane or in space to form the front cut, the executing step including: determining values relating to the book block, including a measured book thickness and a thickness of a book cover, with a higher order control unit along a book production line arranged upstream of the book forming and pressing machine; transmitting the determined values at least to one of the pressing device, the re-forming device and the pressing plates for finishing the book block; selecting one of the forming tools of the re-forming device based on the values that meets operational requirements for the processing of the front cut; and moving the forming tool to an operating position for forming the front cut of the respective book block; and controlling a movement sequence of the pressing plates based on the measured book thickness and thickness of the book cover for the book block.

Thus, according to the invention, a higher order control unit accepts the transfer of values determined along the preceding book production line and continuously transmits these values to the control unit for the book forming and pressing machine which then selects the forming tools for the book forming and pressing machine based on these values, as well as the traversing distances and the required power for the drive units.

If necessary, the values determined along the upstream-arranged book production line may be used for the format adjustment of the discharge station at the book forming and pressing machine or at different, downstream-connected machines.

The re-forming device comprises at least one tool carrier equipped with at least one component embodied as a shaping or forming tool for forming the front cut. The tool carrier or the tool may execute a sequence of movements in a plane or in space, relative to the front cut to be formed, wherein the sequence of movements can be machine adjusted, freely programmable or can optionally be guided by at least one sensor.

The higher order control unit which determines values relating to the book block along the book production line is arranged upstream of the book forming and pressing machine to ensure these values are transmitted to at least the pressing device and/or the re-forming device and/or the pressing plates for the finishing operation of the book block, such that based on the values determined along the book production line prior to the finishing step for the book block, at least the forming tool which meets the forming requirement is selected the operation, that the selected forming tool for the upcoming processing of the respective book block is then moved to the operating position, and that the kinematic force of the pressing plates is controlled during the course of the re-forming operation on the basis of the values for the measured total thickness and the thickness of the book cover for the book block.

In the loading station, the books are moved along successively, or if need be while divided into at least two book flows, and are put into an upright position with the aid of a loading rake with thereto assigned guide web, so that they can subsequently be transported from a loading table provided with prism strips from below into the opened, stopped pressing device while supported on the side by the loading rake and a counter rake. Separate inserts are available for the prism strips to accommodate books having either a rounded or a flat back.

With only slightly closed burn-in rails and pressing plates that are closed with or without pressure, a forming tool of the re-forming device is lowered against the front cut and presses the book block against the back of the cover, thereby causing the two book cover sections to be pulled via the insert and the flyleaf in the joint against the burn-in rails. The book block and the book cover can thus be oriented relative to each other at the same time as the re-forming of the book takes place. The forming tools include separate inserts for the forming of books with a rounded back and a flat back.

With specific configurations of the front cut, it is also possible to use a series of sequentially operated forming tools which gradually form the final shape of the front cut.

An additional feature of this machine is that the operator can input the main dimensions for the book at the operating panel for the machine, or these dimensions can be read out of the job definition format database (JDF), or they can be measured at the preceding machine. The width, height and thickness of a book block trimmed along 3 sides are determined for this in a measuring device while the dimensions of the book cover are measured as well. These values describe the book block which is loaded into the rounding and casing-in machine, arranged upstream of the book forming and pressing machine, but they do not describe the book block which finally leaves this upstream-arranged machine. The book block is rounded and pressed in the upstream-arranged machine, is optionally provided with gauze paper that is glued on and, depending on the embodiment, is provided with a glued-on headband, and the book cover is pre-formed in the back region. Depending on how these processing steps take form, a specialized book form is obtained with respect to the book back and the joint edge once the book block and the book cover are joined.

When inserting a book between the two pressing plates of the book forming and pressing machine, the loading height of the book is adjusted since the form of the rounded book back and the thickness of the back insert influence the position of the book on the prism strips, thus changing the loading height as a consequence.

The loading height is furthermore individually adjusted as a result of the position of the joint edge since this edge is located in the region of the burn-in rail following the loading operation. The forming inserts of the re-forming station are also selected based on the rounding for the book back and the path traversed by the forming tool is preset automatically.

As soon as the last book of an order has exited from the loading station for the book forming and pressing machine and is held in place in a pressing device, the loading station which is provided with a separate drive can be adjusted for a new book format. For the automatic adjustment of the lift for loading the book into the ready, opened pressing device, the form of the rounded book block and the form of the rounded book cover, as well as the rounding radius for the book cover and for the book block or the position of the book joint must be known to the machine control unit in addition to the book thickness, the book height and the book width.

Since these values are generated in the upstream-arranged machine, or are used therein as setting values for applying glue over the complete book block surface and for precisely encasing the book block in the cover, these data only need to be transmitted from there to the control unit for the book forming and pressing machine.

The correct position of the prism strips and the required loading height are then computed with the aid of these values. The adjusted loading position is correct if the burn-in rails hit the intended location in the joint of the inserted book block during the closing of the pressing device.

If the book block is additionally formed with the aid of the forming tool that can be advanced, the geometry of the formed book block is required for the automatic selection of forming inserts. Also required is a precise image of the book block encased in the cover, so that the forming tool can impact softly with the front cut during the forming of the book block and can press the book block with its back region into the rounded book cover, wherein for this the two book cover sections are pulled via the back insert and the flyleaf in the joint against the burn-in rails. The required traversing distance for the forming tool is computed from the selection of forming inserts, the achieved rounding result at the book cover and the book block, as well as the position of the joint edge on the book cover. The book block and the book cover can thus be automatically oriented relative to each other while the book block is simultaneously formed.

BRIEF DESCRIPTION OF THE DRAWINGS

These and other features and advantages of the invention will be further understood from the following detailed description of the embodiments with reference to the accompanying drawings.

DETAILED DESCRIPTION

The method according to the invention for controlling a book forming and pressing machine 20 is illustrated in FIGS. 1 to 6.

These Figures contain specific dimension values that are operatively linked to the control unit and, within the meaning of a complete disclosure of the content, show the concrete steps of detecting, introducing and processing of the corrections values.

Figure 1:
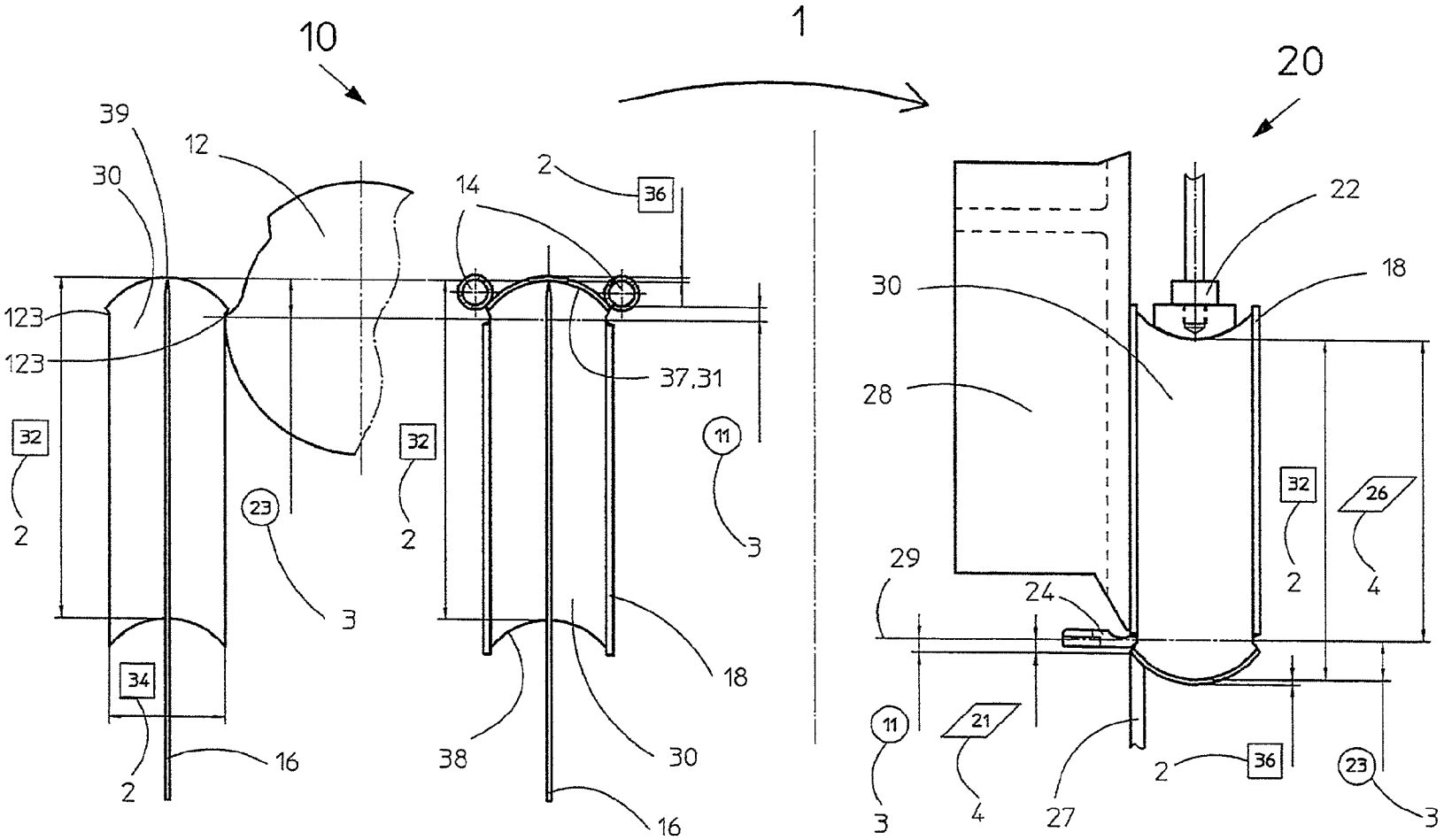
FIG. 1 is a schematic representation, designed to illustrate a data transfer between a book production line and a book forming and pressing machine.

FIG. 1 schematically shows a transfer 1 of data from an upstream arranged machine in a book production line 10 to the book forming and pressing machine 20. With a method realized in a book production line 10 that is arranged upstream of the book forming and pressing machine 20 and is shown to the left of a vertical dash-dot line, a book block 30 is initially arranged without book cover 18 on a transport element 16, a so-called saddle plate. The back of the book block 30, which is formed to correspond to the later book back 37, faces upward in that case. Given this orientation, the book block 30 has a block width 32 in the vertical direction and a book thickness 34 in the horizontal direction. An open front cut 38 is positioned opposite the closed book back 37. With the aid of a glue roller 12, glue is applied to the two outside areas of the book block 30, starting at the joint edge 123.

Following this, the glue-covered book block 30 is combined with a book cover 18. With the aid of a pressing-on device 14, for example in the form of two pressing-on rollers, the supplied book cover 18 is oriented relative to the book block 30 and is secured in place, so that the rounding 31 of the book cover 18 fits precisely over the book back 37. The measured distance between the contact surface of the pressing-on rollers of the pressing-on device 14 on the book cover 18 and the joint edge 123 can be called up as a setting 11 for the pressing-on device 14.

Glue is applied in the process to the complete surfaces of the book block 30 positioned on the saddle plate, that is during the upward movement between two glue rollers 12, and the book block back comes in contact with the pre-formed insert for the book cover arranged above in a horizontal position. The pressing-on rollers of the pressing-on device 14 push the insert of the book cover 18 against the book block back and the pressing-on device 14 then moves synchronously along with the book block 30 on the saddle plate. During the upward movement, the two halves of the book cover 18 are folded down and fit themselves against the glue-covered surfaces of the book block 30. As soon as the two halves fit completely against the book block 30, the pressing-on device 14 moves downward, the pressing on rollers are pushed apart somewhat by the mushroom form of the book back 37 and return with spring force to press the book cover 18 against the glue-covered book block 30. As a result, the pressing-on rollers of the pressing-on device 14 execute a controlled, vertical movement and a spring-loaded, small horizontal movement.

The following data are thus known as input values 2 before the inventive method is realized by the book forming and pressing machine 20: the book width 32, the book thickness 34 and an insert thickness 36 of the book cover 18. The computed values 3 of the book production line 10 are the values for the distance 23 between a top of the book block back and the joint edge 123 and the pressing-on device setting 11. The data transfer is furthermore illustrated in FIG. 2.

Figure 2:
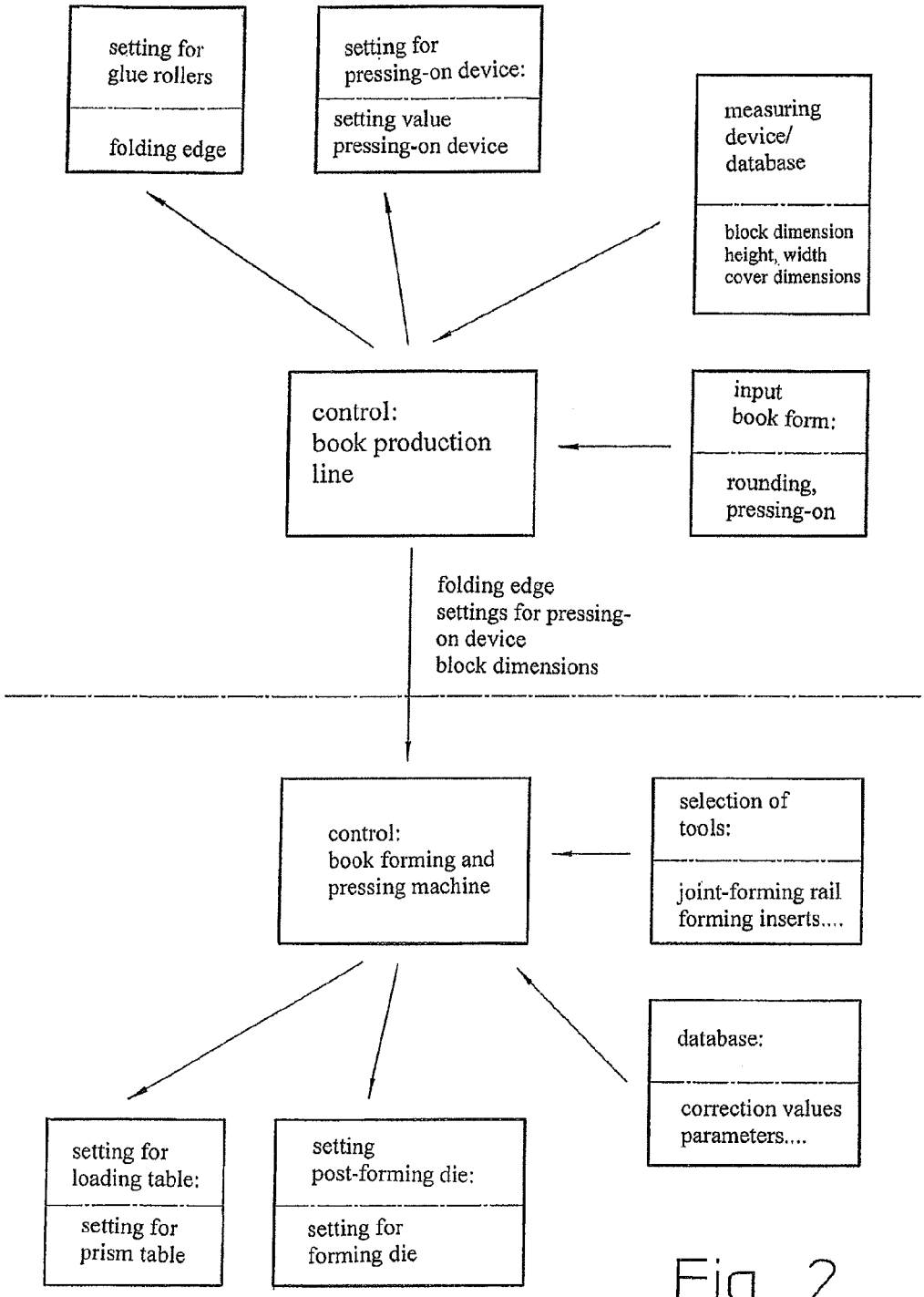
FIG. 2 is a flow chart for illustrating the signal flows around a control unit for the book production line, around a control unit for the book forming and pressing machine, and between these control units.

According to FIGS. 1 and 2, the computed values 3 of the book production line 10 for the distance 23 between a top of the book block back and the joint edge 123 and the setting 11 for the pressing-on device 14, and the input values 2 for the book format are transferred via a data transfer 1 to the control unit for the book forming and pressing machine 20.

The flow chart shown in FIG. 1, to the right of the dash-dot line, shows a standard arrangement of the book block 30, with the book back 37 facing downward, in the book forming and pressing machine 20. Pressing plates 28 press the book cover 18 from the left side and the right side against the book block 30 so that it fits flat against the book block 30 (only the left pressing plate 28 is shown herein). The book rests with its book back 37 on a loading table 27 which can be adjusted in height by a loading table setting 21.

A standard configuration of the loading table 27 consists of two prism plates which are arranged parallel to each other (only a section of the left prism plate is indicated herein). The book back 37 makes contact with these prism plates along at least two contact lines. Below the pressing plates 28 and above the loading table 27, a pointed burn-in rail 24 can be moved from both sides (only the left side is shown herein) in the region of the joint edge 23 against the book cover 18 and the book block 30.

The burn-in rail 24 point, which faces the book, determines a horizontal zero line 29 as one of several options, based on which the settings 21, 26 of the book forming and pressing device 20 are adjusted.

The book forming and pressing machine 20 furthermore comprises a forming tool 22 as a component of a re-forming device. The forming tool 22 can be lowered by the value for the forming tool setting 26 from above onto the front cut 38. The forming tool is arranged on a tool carrier, not shown in further detail, and executes a series of movements in a plane or in space for the forming of the front cut 38, wherein the sequence of movements is machine controlled, freely programmable, or can optionally be guided by at least one sensor that is not shown herein. Such a sensor continuously detects directly or indirectly at least one information relating to the position of one or several forming tools 22 of the re-forming device in a movement plane or in space, or it detects the position of the operatively specified forming tool 22 and transmits this information relating to the position and/or transmits the position itself to the control unit.

According to the inventive method, the loading table 27 of the book forming and pressing machine 20 must first be moved to the correct height, meaning to the loading table setting 21 as a first computed value 4 for the book forming and pressing machine 20. For this, the loading table 27 can be operated with a non-depicted displacement sensor. According to a first embodiment of the inventive method and using a burn-in rail 24 with the tip positioned at the level of the zero line 29, the pressing-on device setting 11 is used as the loading table setting 21.

Figure 5:
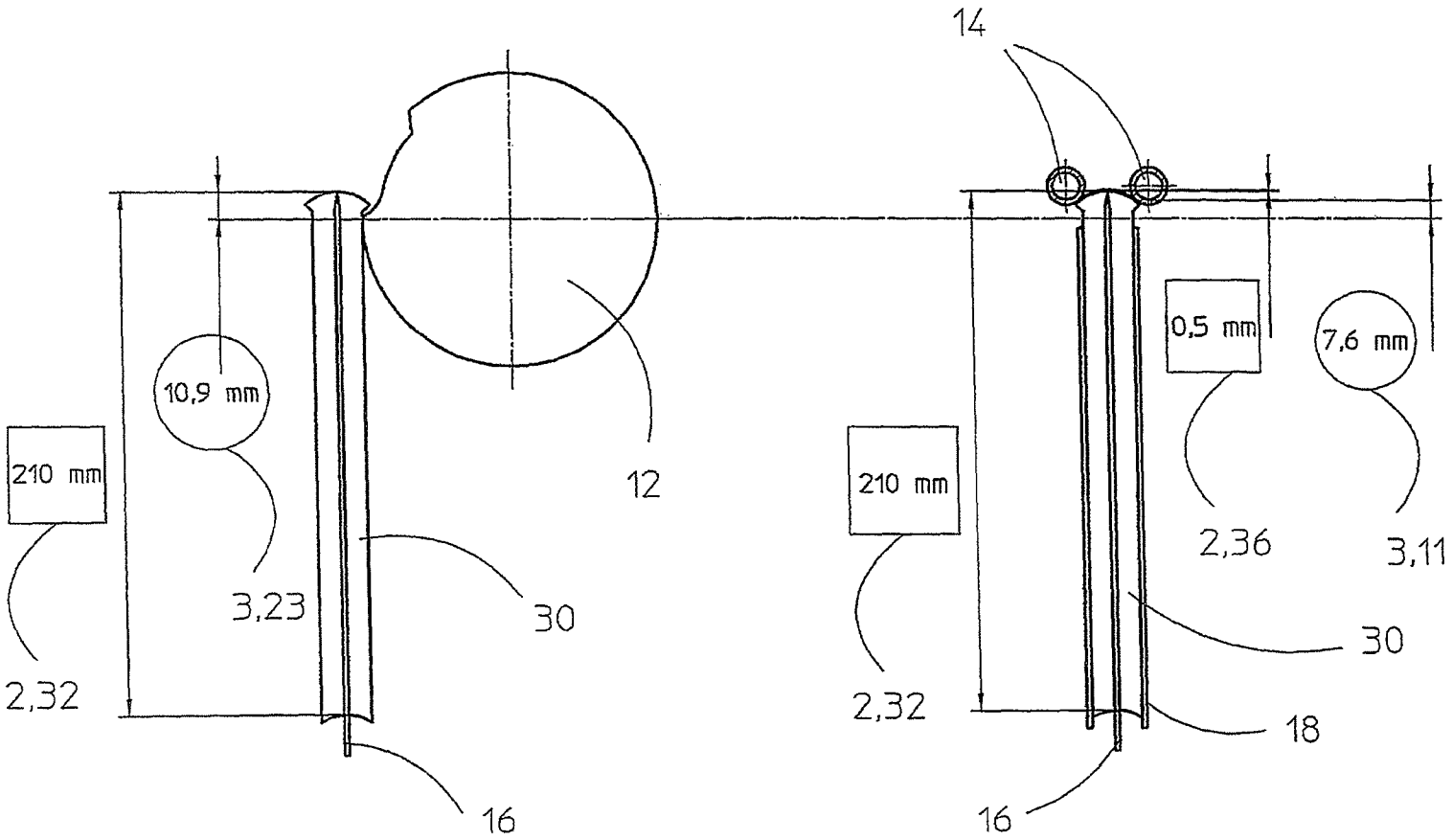
FIG. 5 a representation analogous to FIG. 3, with a 20 mm thick book.
Figure 6:
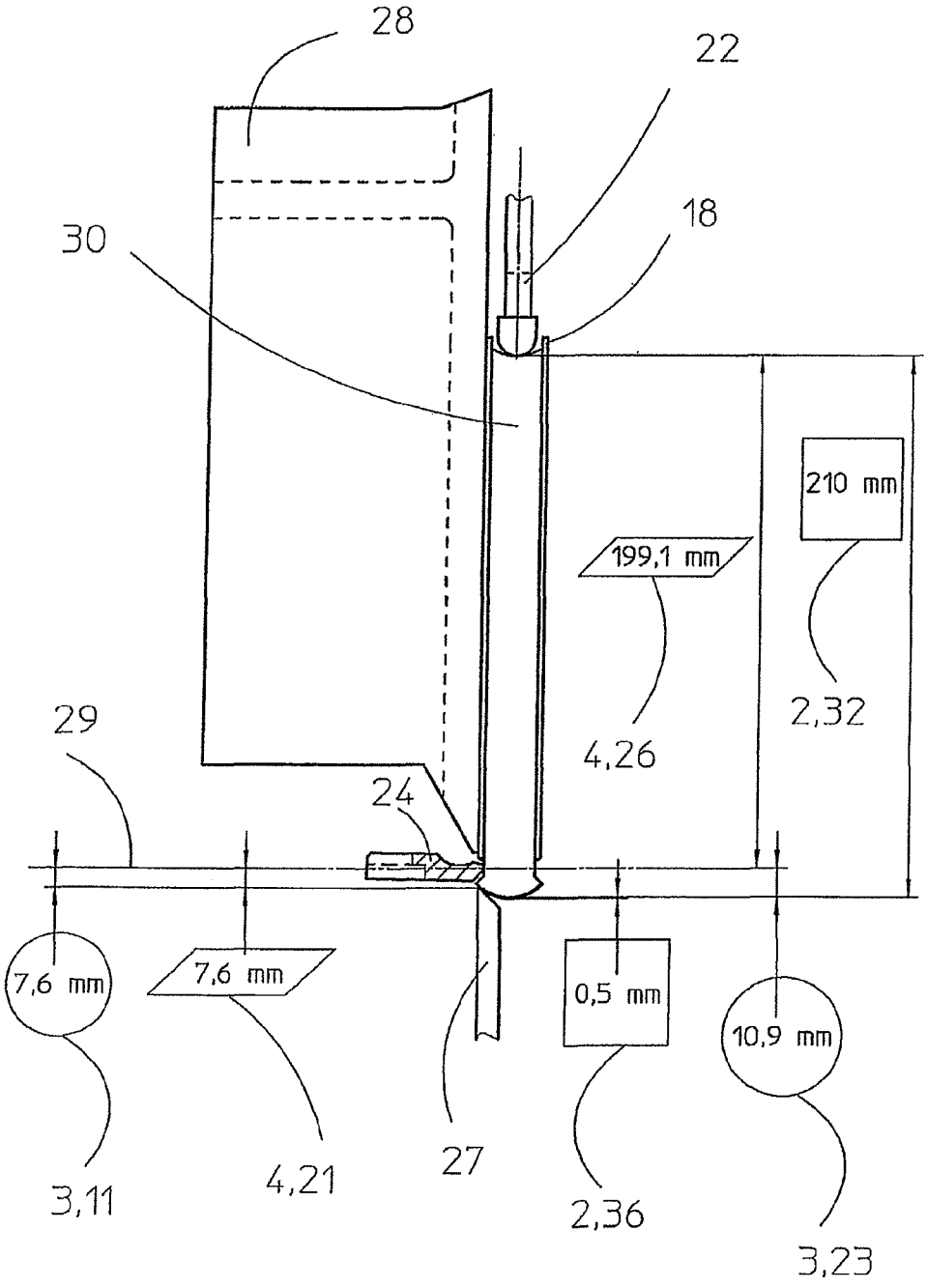
FIG. 6 a representation analogous to FIG. 4, with the pointed burn-in rail and the thin book from FIG. 5, measuring 20 mm.

In the first exemplary embodiment, the setting values 21, 26 in FIGS. 5 and 6 are computed to correspond to a thin book of 20 mm.

The loading table setting 21, as computed value 4 for the book forming and pressing machine 20, is equal to the setting 11 for the pressing-on device 14 as computed value 3 for the book production line 10.

Figure 3:
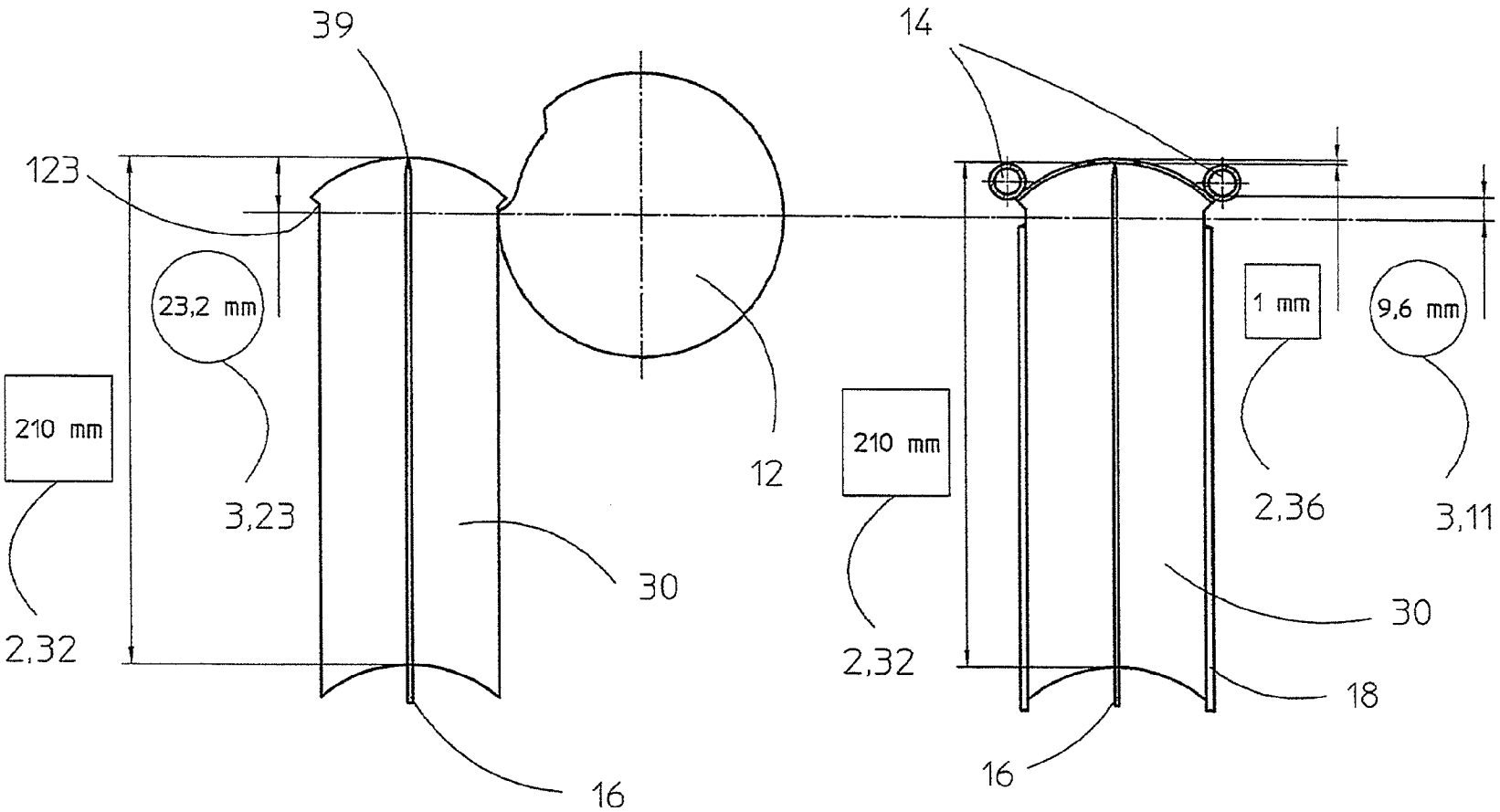
FIG. 3 is a further schematic representation, similar to the one in FIG. 1, showing the left side of a book production line for illustrating the detection of settings used in the book production line when processing an 80 mm thick book.

According to one embodiment of the inventive method, the value for the book thickness 34 is incorporated into the computation for the pressing-on device setting 11, which is obvious when comparing FIGS. 3 and 5.

The forming tool setting 26 as computed value 4 for the book forming and pressing machine 20 is equal to a difference obtained when deducting the distance 23 between a top of the book block back and the joint edge 123 as computed book production line value 3 from the block width 32 as input value 2.

According to a second embodiment of the inventive method, an upper edge of a blunt burn-in rail 24' (FIG. 4) determines the zero line 29 (see FIGS. 3 and 4) in place of the tip of the burn-in rail 24, as shown in FIGS. 1, 5 and 6.

The loading table setting 21 and the forming tool setting 26 are converted by the control unit for the book forming and pressing machine 20 in the same way as for the first embodiment, relative to the zero line 29, by activating fast actuators, for example linear servo motors, which are not shown further herein, for the loading table 27 and the forming tool 22.

Figure 4:
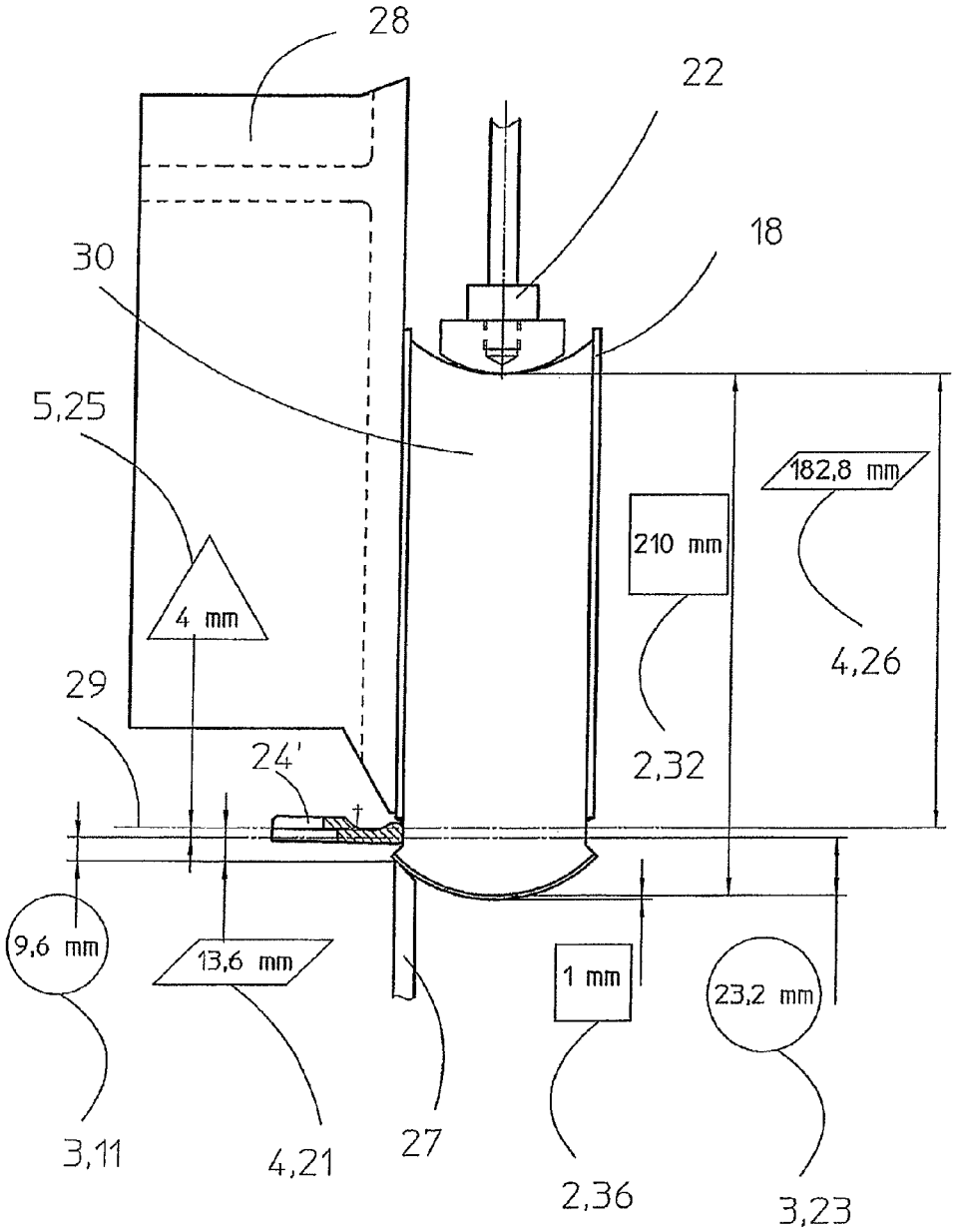
FIG. 4 is another schematic representation, referring to FIG. 1, showing the right side of the book forming and pressing machine for illustrating the computing of setting for relevant components of the book forming and pressing machine, using the example of the 80 mm thick book shown in FIG. 3.

According to the second embodiment shown in FIGS. 3 and 4, the loading table setting 21 as computed value 4 for the book forming and pressing machine 20 is equal to the sum of the setting 11 for the pressing-on device 14 as computed value 3 for the book production line 20 and a correction setting 25 for the burn-in rail 24, which is correspondingly taken into consideration as tool correction setting 5 for the obtuse burn-in rail 24'.

According to the second embodiment and/or the FIGS. 3 and 4, the forming tool setting 26 as computed book forming and pressing machine value 4 is equal to a difference between the block width 32 as input value 2 minus the distance 23 between a top of the book block back and the joint edge 123 as computed book production line value 3 and minus the correction setting for the burn-in rail 25 as tool correction setting 5.

Based on a further advantageous embodiment of the invention, which is not shown in detail in the schematic representation according to FIG. 1, an adjustment of the prism plates on an adjustable loading table 27 is taken into consideration when computing the settings 21, 26 as further tool correction setting 5.

According to yet another advantageous embodiment of the inventive method, a replacement forming tool 22 is furthermore taken into consideration as a tool correction setting 5, in particular when computing the forming tool setting 26.

The following qualitative dependencies can be recognized when operating such a book forming and pressing machine:

a) The joint edge and the setting for the pressing-on device are computed in the book production line.

b) The height of the prism table is a function of the pressing-on device setting and the form of the burn-in rail (width of burn-in joint), wherein it should be taken into account that the back insert thickness has already been considered in the setting for the pressing-on device, wherein in FIGS. 5 and 6 the height of the prism table, put in a simplified manner, corresponds to the pressing-on device setting.

It will be understood that the above description of the present invention is susceptible to various modifications, changes and adaptations, and the same are intended to be comprehended within the meaning and range of equivalents of the appended claims.

What is claimed is:

1. A method for operating a book forming and pressing machine including a re-forming device, a pressing device and a loading device, wherein the loading device includes a loading table and the pressing device includes a number of spaced-apart pressing plates and burn-in rails, wherein the re-forming device includes a plurality of forming tools adapted to form a front cut of a book block, and the pressing device includes at least one station to accommodate a book block, the method comprising:

determining values relating to the book block, including a measured book thickness and a thickness of a book cover, with a higher order control unit along a book production line arranged upstream of the book forming and pressing machine;

transmitting the determined values at least to one of the pressing device, the re-forming device and the pressing plates for finishing the book block;

selecting one of the forming tools of the re-forming device based on the values that meets operational requirements for the processing of the front cut;

moving the selected forming tool in a plane or in space to an operating position for forming the front cut of the respective book block; and controlling a movement sequence of the pressing plates at least based on the measured book thickness and the thickness of the book cover for the book block.

2. The method according to claim 1, further including processing the front cut to be formed with a series of forming tools of the re-forming device.

3. The method according to claim 1, including displacing the loading table that accommodates the book block in a vertical direction, starting from an imagined horizontal zero line that is locally fixed in the book forming and pressing machine, by a setting value for the loading table.

4. The method according to claim 3, further including at least one of pressing the selected forming tool in a direction counter to the loading table and displacing the forming tool vertically based on a forming tool setting value, to press the forming tool onto the front cut of the book block that is arranged parallel to the loading table.

5. The method according to claim 4, further including selecting at least one of loading table setting value and the forming tool setting value in dependence on values relating to the book block obtained along the upstream arranged book production line.

6. The method according to claim 5, including additionally selecting at least one of the loading table setting value and the forming tool setting value in dependence on book parameters known for the book block and the book cover, including at least one of the block width, the book thickness and a back insert thickness which can be called up from a central database for control of the book forming and pressing machine.

7. The method according to claim 5, including additionally selecting at least one the loading table setting value and the forming tool setting value in dependence on at least one tool correction setting which is distinctive for a specific adjustable and replaceable component of the book forming and pressing machine, including at least one correction setting for the selected forming tool, a form of a burn-in rail, or a position of the loading table.

8. The method according to claim 3, including selecting the loading table setting in dependence on a setting from the book production line for a total-surface glue application of the book block.

9. The method according to claim 3, including selecting the loading table setting value in dependence on a pressing-on device setting of the book production line, wherein a fed-in book cover is oriented relative to a book block with aid of the pressing-on device, upstream of the book forming and pressing machine.

10. The method according to claim 3, including selecting the loading table setting in dependence on a setting for the book production line to ensure a precise encasing of the book block in a book cover.

11. The method according to claim 1, including adjusting the series of movements of the forming tool in a plane or in space by a machine.

12. The method according to claim 1, wherein the series of movements of the forming tool in a plane or in space are freely programmed.

13. The method according to claim 1, including adjusting the series of movements of the forming tool in a plane or in space with aid of at least one sensor.

14. The method according to claim 1, wherein the executing step includes executing at least one further translational movement crosswise to a width of the front cut and at least one vertical or quasi-vertical forming movement relative to the front cut.

15. The method according to claim 1, wherein the moving step includes: a) continuously detecting with at least one sensor either directly or indirectly at least one information on a position of at least one of the forming tools of the re-forming device in a movement plane or in space, or b) detecting the position of the selected forming tool and transmitting the position to a control unit.

16. The method according to claim 1, including positioning the book block which rests on prism plates at a predetermined height between the pressing plates such that the burn-in rails hit a joint region of the book block with a lower force and so that the book block is held in place during a lowering of the loading table.

17. The method according to claim 1, including detecting with a signal device a contour of the book block during a loading of the book block, and moving the loading table with aid of a drive to a specified height.

18. The method according to claim 17, including operating the loading table with a displacement sensor.

19. The method according to claim 1, including pre-pressing the book block with the pressing plates during a re-forming process and then fixing the book block following the re-forming process by increasing the pressure of the burn-in rails and subsequently moving the re-forming device out of a region of the pressing plates.

* * * * *